US011754961B2

(12) United States Patent
Takenaka

(10) Patent No.: US 11,754,961 B2
(45) Date of Patent: Sep. 12, 2023

(54) IMAGE FORMING APPARATUS, AND METHOD OF CONTROLLING IMAGE FORMING APPARATUS

(71) Applicant: CANON KABUSHIKI KAISHA, Tokyo (JP)

(72) Inventor: Shuichi Takenaka, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 26 days.

(21) Appl. No.: 17/216,325

(22) Filed: Mar. 29, 2021

(65) Prior Publication Data

US 2021/0318654 A1 Oct. 14, 2021

(30) Foreign Application Priority Data

Apr. 10, 2020 (JP) ..... 2020-071152

(51) Int. Cl.
*G03G 15/00* (2006.01)

(52) U.S. Cl.
CPC ..... *G03G 15/6511* (2013.01); *G03G 15/5016* (2013.01)

(58) Field of Classification Search
CPC ..... G03G 15/6511; G03G 15/5016
See application file for complete search history.

(56) References Cited

U.S. PATENT DOCUMENTS 9,681,010 B2 * 6/2017 Okada ..... H04N 1/0032
2012/0133968 A1 * 5/2012 Hirose ..... G06K 15/1859 358/1.13
2015/0022667 A1 * 1/2015 McManus ..... H04N 5/33 348/164
2015/0206035 A1 * 7/2015 Yamashita ..... H04N 1/00204 358/1.9
2015/0382136 A1 * 12/2015 Mihira ..... H04W 76/14 455/41.1
2017/0316289 A1 * 11/2017 Miyagi ..... G06K 15/1822
2017/0318184 A1 * 11/2017 Suzuki ..... H04N 1/00973
(Continued)

FOREIGN PATENT DOCUMENTS

JP 2002278377 A 9/2002

OTHER PUBLICATIONS

Katsura, Machine Translation of JP 2002-278377, 2002, JPO (Year: 2002).*

*Primary Examiner* — David H Banh
(74) *Attorney, Agent, or Firm* — Canon U.S.A., Inc. I.P. Division

(57) ABSTRACT

An image forming apparatus includes a sheet feeding unit storing a sheet, an image forming unit, a display unit, and one or more processors. The image forming unit forms an image on the sheet conveyed from the sheet feeding unit. The display unit displays a screen. The one or more processors perform control to cause the display unit to display a first sheet setting screen for setting sheet information about the sheet feeding unit on which a predetermined operation is performed based on the performance of the predetermined operation on the sheet feeding unit while a setting screen that prompts a user to make a copy-related setting is displayed. Where the predetermined operation is performed while a second sheet setting screen for setting sheet information about the sheet feeding unit is displayed, the one or more processors cause the display unit not to display the first sheet setting screen.

12 Claims, 11 Drawing Sheets

(56) References Cited

U.S. PATENT DOCUMENTS

| | | | | |
|---|---|---|---|---|
| 2018/0335718 | A1* | 11/2018 | Chikugo | G03G 15/607 |
| 2019/0095155 | A1* | 3/2019 | Mizutani | G06F 3/1253 |
| 2019/0109958 | A1* | 4/2019 | Nakajima | H04N 1/00204 |
| 2020/0034007 | A1* | 1/2020 | Kawano | G06N 3/0481 |
| 2020/0272370 | A1* | 8/2020 | Hagiwara | G06F 3/1205 |
| 2020/0293235 | A1* | 9/2020 | Chew | G06F 3/1205 |
| 2021/0318654 | A1* | 10/2021 | Takenaka | G03G 15/6594 |

* cited by examiner

IMAGE FORMING APPARATUS, AND METHOD OF CONTROLLING IMAGE FORMING APPARATUS

BACKGROUND

Field

The present disclosure relates to an image forming apparatus and a method of controlling an image forming apparatus.

Description of the Related Art

It is known that in an image forming apparatus that conveys a sheet from a sheet feeding cassette and forms an image on the conveyed sheet, sheet information, such as a sheet size and a sheet type, about sheets stored in the sheet feeding cassette is registered for each sheet feeding cassette. In changing a sheet stored in the sheet feeding cassette, a user sets the size and type of the new sheet to be stored by operating an operation unit of the image forming apparatus.

Japanese Patent Application Laid-Open No. 2002-278377 discusses an image forming apparatus that includes a display unit. In a case where an operation of removing or inserting a sheet feeding cassette from or into a sheet feeding cassette storage unit is detected, the display unit displays a screen for setting sheet information about the operated sheet feeding cassette.

Each time a predetermined operation on a sheet feeding cassette is detected, the image forming apparatus discussed in Japanese Patent Application Laid-Open No. 2002-278377 displays a pop-up sheet setting screen. Even in a case where, for example, the sheet information setting screen is displayed by a user before the predetermined operation on the sheet feeding cassette, the sheet information setting screen for the sheet feeding cassette on which the predetermined operation is performed is displayed based on the predetermined operation on the sheet feeding cassette. Thus, the user cannot continue to make the sheet information settings displayed before the predetermined operation until the displayed settings for the sheet feeding cassette on which the predetermined operation is performed are completely made.

SUMMARY

According to an aspect of the present disclosure, an image forming apparatus includes a sheet feeding unit configured to store a sheet, an image forming unit configured to form an image on the sheet conveyed from the sheet feeding unit, a display unit configured to display a screen, and one or more processors configured to perform control to cause the display unit to display a first sheet setting screen for setting sheet information about the sheet feeding unit on which a predetermined operation is performed based on the performance of the predetermined operation on the sheet feeding unit while a setting screen that prompts a user to make a copy-related setting is displayed, wherein, in a case where the predetermined operation is performed while a second sheet setting screen for setting sheet information about the sheet feeding unit is displayed, the one or more processors cause the display unit not to display the first sheet setting screen.

Further features of the present disclosure will become apparent from the following description of exemplary embodiments with reference to the attached drawings.

DESCRIPTION OF THE EMBODIMENTS

Various exemplary embodiments of the present disclosure will be described below with reference to the drawings.

First, operations of an image forming apparatus according to a first exemplary embodiment will be described below.

Figure 4A:
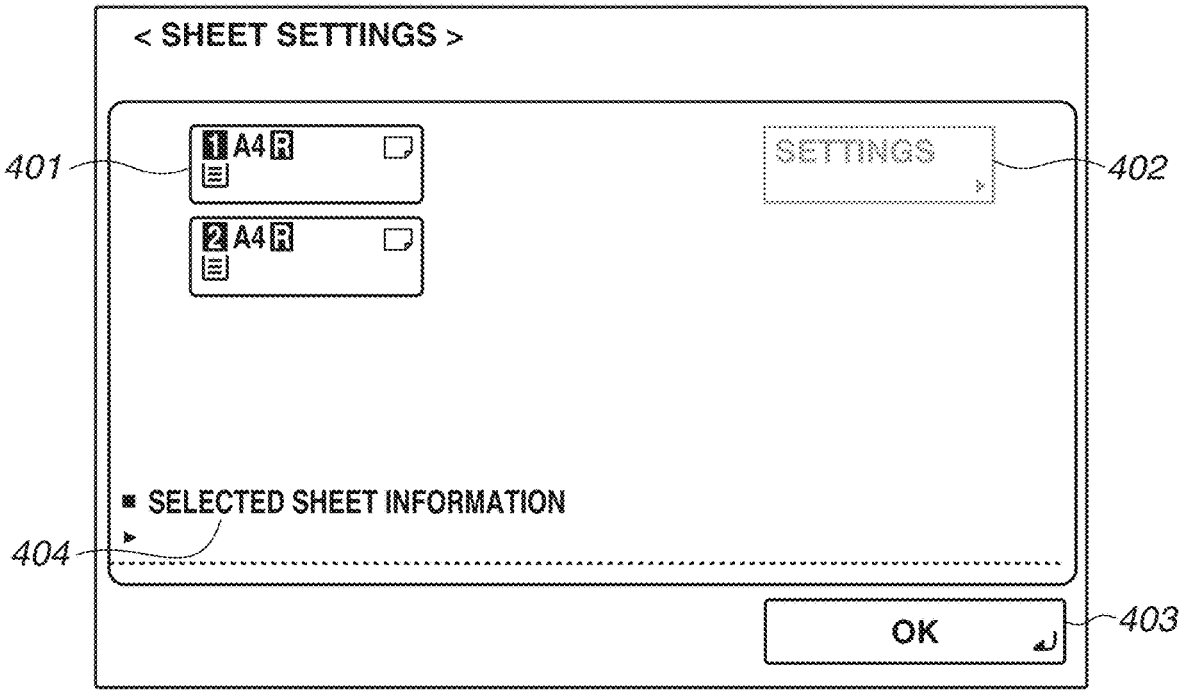
FIGS. 4A and 4B are diagrams illustrating an example of an initial screen of a sheet setting screen according to an exemplary embodiment.
Figure 4B:
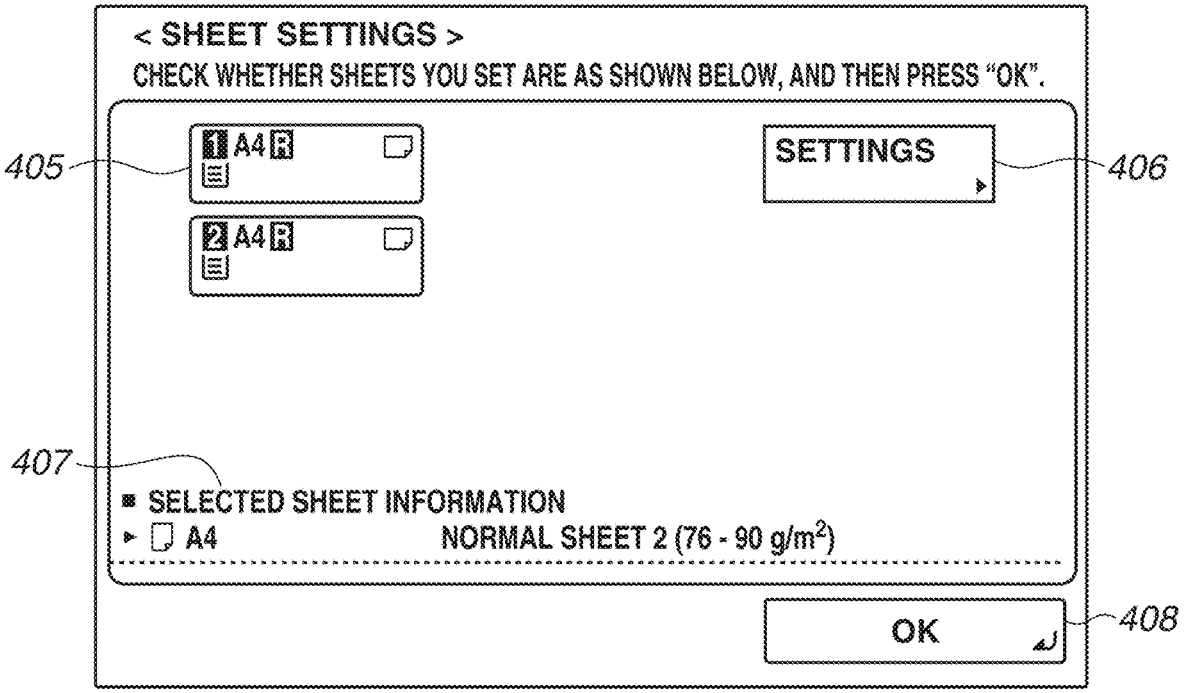

If the image forming apparatus according to the first exemplary embodiment detects the setting of a sheet in a sheet feeding cassette, the image forming apparatus displays a pop-up sheet setting screen as illustrated in FIG. 4B and prompts a user to set the sheet size of the set medium. In the screen in FIG. 4B, the screen is displayed in a state where the cassette in which the user sets a sheet is selected.

Figure 11A:
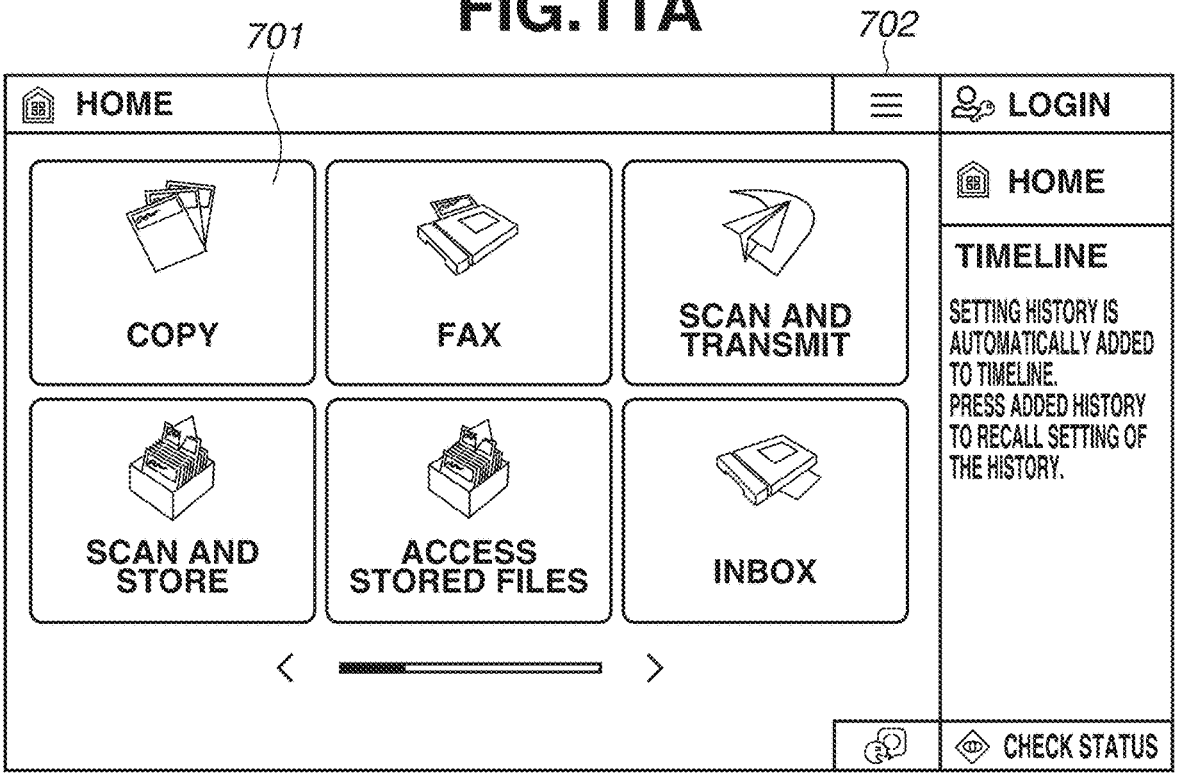
FIGS. 11A and 11B are diagrams illustrating an example of a screen displayed on an operation unit of an image forming apparatus according to an exemplary embodiment.

Further, a sheet information setting screen illustrated in FIG. 4A can be displayed by selecting a sheet setting on a screen displayed by selecting a button 702 on a home screen in FIG. 11A. The screen illustrated in FIG. 4A is a screen via which a user can set sheet information without setting a sheet in a sheet feeding cassette.

In a case where a user opens a sheet feeding cassette, places a sheet in the sheet feeding cassette, and closes the sheet feeding cassette while the sheet information setting screen illustrated in FIG. 4A is displayed, if the pop-up screen is displayed, the user cannot continue to change the settings on the screen illustrated in FIG. 4A.

Thus, in the first exemplary embodiment, while the screen illustrated in FIG. 4A is displayed, the pop-up screen illustrated in FIG. 4B is controlled not to be displayed even in a case where a sheet feeding cassette is opened or closed and a sheet is set in the sheet feeding cassette.

<System Configuration Diagram>

Figure 1:
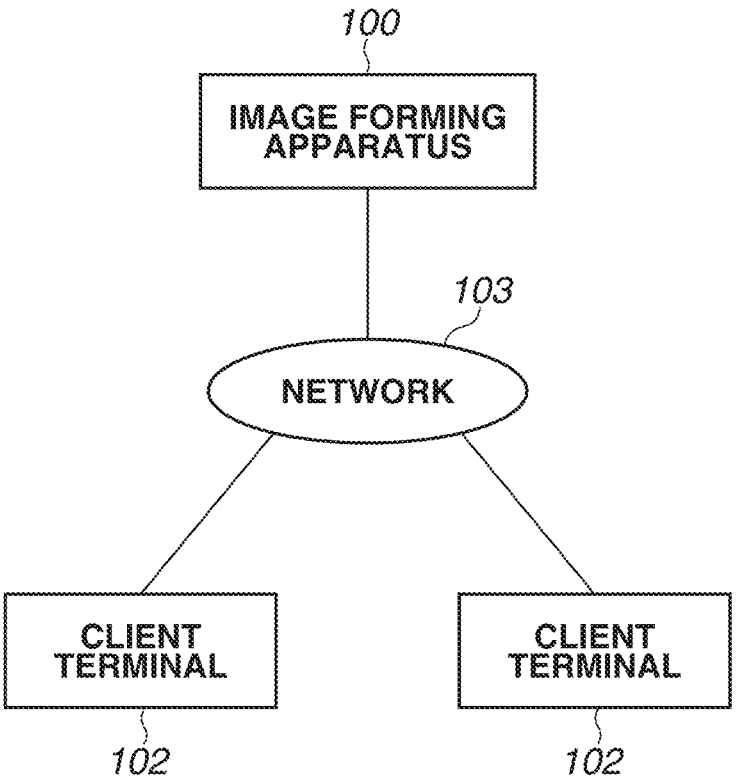
FIG. 1 is a diagram illustrating an example of a system configuration according to an exemplary embodiment.

First, an example of a configuration of a system according to the present exemplary embodiment will be described below with reference to FIG. 1. The system according to the present exemplary embodiment includes an image forming apparatus 100 and client terminals 102. The image forming apparatus 100 is connected to the plurality of client terminals 102 via a network 103.

The image forming apparatus 100 is a multi-function peripheral including various functions such as scan, facsimile, and print functions or is a printer including only a print function.

Each client terminal 102 is an information processing apparatus of a user, such as a personal computer (PC), a mobile phone, a personal digital assistant (PDA), a multi-function mobile phone (hereinafter, referred to as "smartphone"), or a tablet. The client terminals 102 transmit print data to the image forming apparatus 100 via the network 103.

The network 103 is a wireless or wired network, such as a wide area network (WAN) or a local area network (LAN).

<Hardware Block Diagram of Image Forming Apparatus>

Figure 2A:
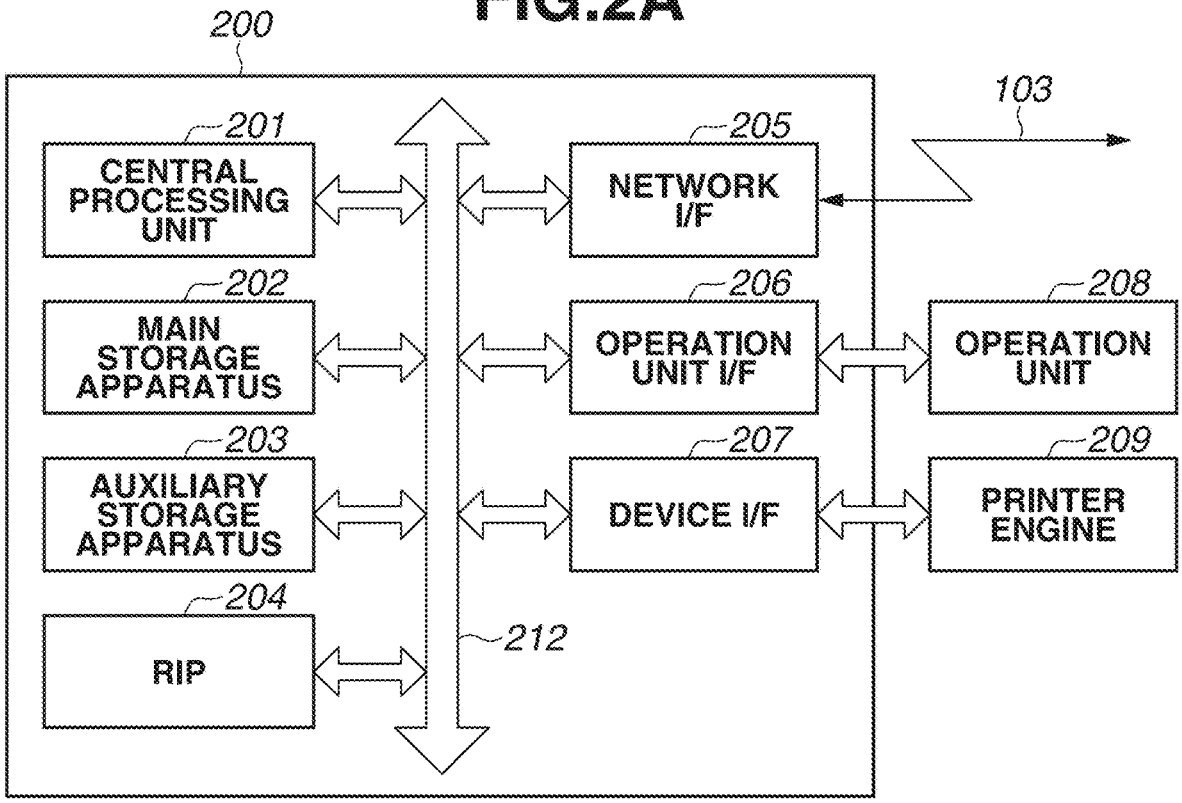
FIGS. 2A and 2B are diagrams illustrating an example of hardware blocks of an image forming apparatus according to an exemplary embodiment.

FIG. 2A is a hardware block diagram illustrating an example of a configuration of the image forming apparatus 100 according to the present exemplary embodiment. In FIG. 2A, a controller unit 200 controls inputting and outputting of image signals and device information.

A central processing apparatus (CPU) 201 reads a program stored in an auxiliary storage apparatus 203 to a main storage apparatus 202 and executes the read program. Further, the CPU 201 comprehensively controls each device connected to a system bus 212.

The main storage apparatus 202 functions as a main memory of the CPU 201 and a work memory. A memory device such as a random access memory is used as the main storage apparatus 202.

The auxiliary storage apparatus 203 is also used to store a large amount of data temporarily or for a long time. A storage apparatus such as a read-only memory (ROM), a hard disk drive (HDD), or a solid-state drive (SSD) is used as the auxiliary storage apparatus 203.

A raster image processor (RIP) 204 is dedicated hardware that rasterizes intermediate print data into a raster image. The RIP 204 processes intermediate print data generated on the main storage apparatus 202 by the CPU 201 at high speed and in parallel with the execution by the CPU 201.

A network interface (network I/F) 205 is connected to the network 103, and print data and device information are input from and output to a device outside the printer via the network I/F 205.

An operation interface (operation I/F) 206 is an interface unit for an operation unit 208 and outputs image data to be displayed on the operation unit 208 to the operation unit 208. Further, the operation I/F 206 plays the role of transmitting information input by the user of the apparatus via the operation unit 208 to the CPU 201.

A device interface (device I/F) 207 transmits image signals, issues device operation instructions, and receives device information based on instructions from the CPU 201. The controller unit 200 is connected to a printer engine 209 via the device I/F 207. In the first exemplary embodiment, the opening and closing of a sheet feeding cassette and the setting of a sheet in a sheet feeding cassette are detected by the printer engine 209, and the detection results are transmitted to the CPU 201 via the device I/F 207. Alternatively, the opening and closing of a sheet feeding cassette and the setting of a sheet in a sheet feeding cassette may be detected by the controller unit 200.

The operation unit 208 includes a liquid crystal panel and a sound source as output devices and includes input devices such as a touch panel, hardware keys, and a microphone.

The printer engine 209 is an image forming unit that outputs image signals from the controller unit 200 onto media. The printer engine 209 can be either one of an electrophotographic image forming unit and an inkjet image forming unit. The image forming apparatus 100 includes one or more sheet feeding cassettes and conveys a sheet from the one or more sheet feeding cassettes to the printer engine 209. Further, the image forming apparatus 100 can further include a manual sheet feeding tray as an optional component added to the device body. The same type of sheets or different types of sheets can be set in each sheet feeding cassette and on the manual sheet feeding tray.

Figure 2B:
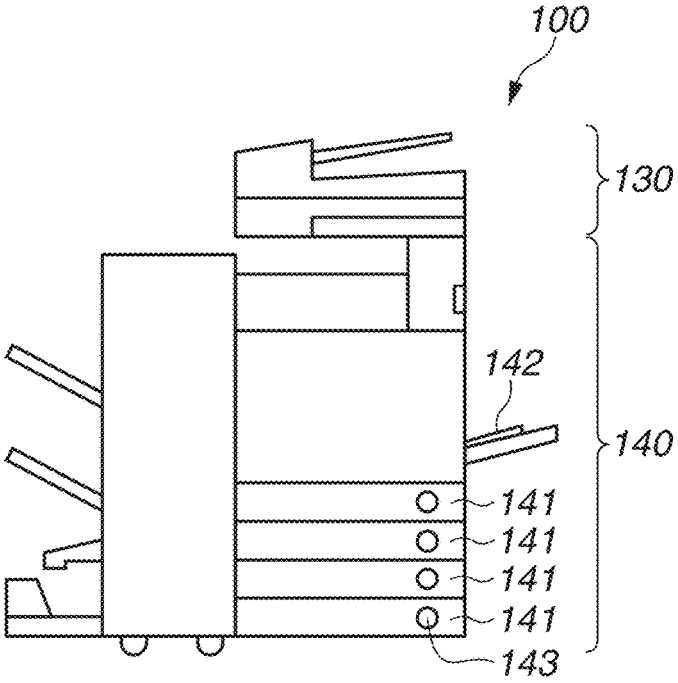

FIG. 2B is an external view illustrating the image forming apparatus 100. The image forming apparatus 100 includes a scanner 130 on top of a printer 140. The printer 140 includes a plurality of sheet feeding cassettes 141. The plurality of sheet feeding cassettes 141 is a sheet feeding unit that can store several hundreds of sheets in each stage. Further, the printer 140 includes a manual sheet feeding tray 142, and sheets are replaced with ease on the manual sheet feeding tray 142. The sheet feeding cassettes 141 are removably attached to the image forming apparatus 100. Sheet information such as the size and type of sheets placed in the sheet feeding cassette 141 and the size and type of sheets placed on the manual sheet feeding tray 142 is set by a user via an operation screen. The user-set sheet information such as the sheet size and the sheet type is stored in association with the sheet feeding cassette 141 or the manual sheet feeding tray 142 in the auxiliary storage apparatus 203. The image forming apparatus 100 can include a mechanism of detecting the size and type of a sheet in the sheet feeding cassette 141 and the size and type of a sheet on the manual sheet feeding tray 142. In a case where the sheet feeding cassette 141 and the manual sheet feeding tray 142 include a mechanism of detecting the sheet size and the sheet type, detection results can be set to the sheet feeding cassette 141 and the manual sheet feeding tray 142. Each of the sheet feeding cassette 141 and the manual sheet feeding tray 142 is also referred to as a sheet feeding stage. Further, a finisher (not illustrated) is connected to the printer 140. The finisher includes a function of stapling as a post-process, such as stapling, stapleless stapling, and saddle stapling. The finisher 1 can further include a folding function, a punching function, and a bookbinding function besides the stapling function.

A button 143 is a button for removing the sheet feeding cassette 141. The sheet feeding cassette 141 can be removed at the press of the button 143 by a user. To store a sheet in the sheet feeding cassette 141, a user presses the button 143 and then removes the sheet feeding cassette 141 and stores the sheet in the sheet feeding cassette 141. Then, the user pushes the sheet feeding cassette 141 into a cassette storage unit of the printer 140. The cassette storage unit of the printer 140 for storing the sheet feeding cassette 141 includes a sensor that detects a closed state of the sheet feeding cassette 141, and the image forming apparatus 100 determines whether the sheet feeding cassette 141 is opened or closed based on a detection result of the sensor. In the present exemplary embodiment, the sheet feeding cassette 141 includes the button 143. Alternatively, the sheet feeding cassette 141 does not include the button 143, and a user can remove the sheet feeding cassette 141. Further, the sensor of the image forming apparatus 100 can detect the opening and closing of the sheet feeding cassette 141.

<Software Module Diagram of Image Forming Apparatus>

Figure 3:
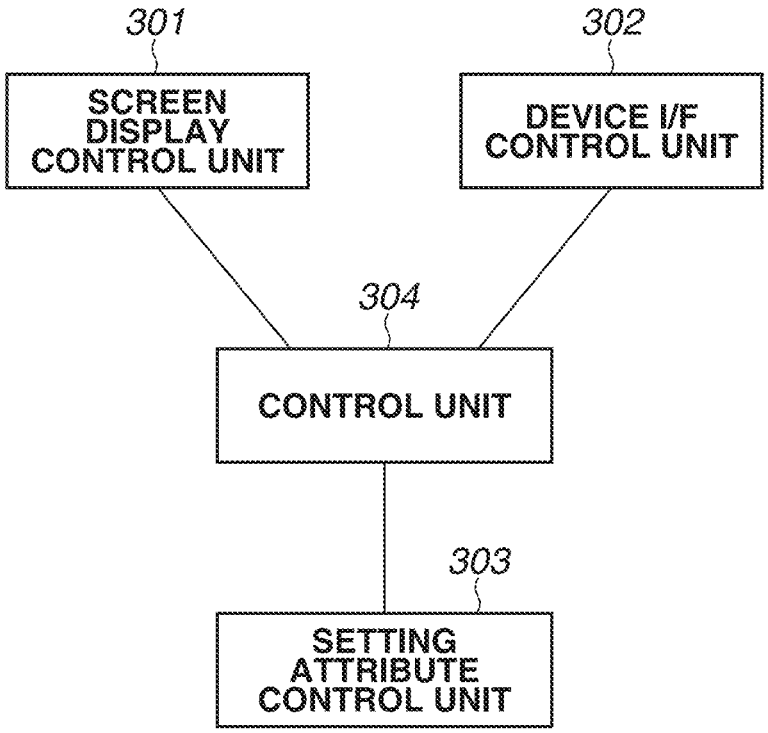
FIG. 3 is a diagram illustrating an example of software modules of the image forming apparatus according to an exemplary embodiment.

FIG. 3 is a diagram illustrating a software module configuration of the image forming apparatus 100 according to the present exemplary embodiment. Each software module illustrated in FIG. 3 is stored as a program in the auxiliary storage apparatus 203, and the CPU 201 loads the program onto the main storage apparatus 202 and executes the loaded program.

A screen display control unit 301 controls a display by transferring, replacing, or updating an image displayed on the operation unit 208 using the operation I/F 206.

A device I/F control unit 302 communicates signals to the printer engine 209 using the device I/F 207. The device I/F control unit 302 transmits image signals, issues device operation instructions, and receives device information. The detection of the opening and closing of the sheet feeding cassette 141 and the detection of whether a sheet is in the sheet feeding cassette 141 in the first exemplary embodiment are also controlled by the device I/F control unit 302.

A setting attribute control unit 303 plays the role of managing and updating various setting values set by a user via the operation unit 208.

A control unit 304 comprehensively controls the switching of a screen display, the communication with the printer engine 209, and the switching of setting attribute values of various print settings.

<UI Screen of Initial Screen of Sheet Setting Screen>

User operations for changing information about sheets stored in the sheet feeding cassette 141 will be described below.

Figure 11B:
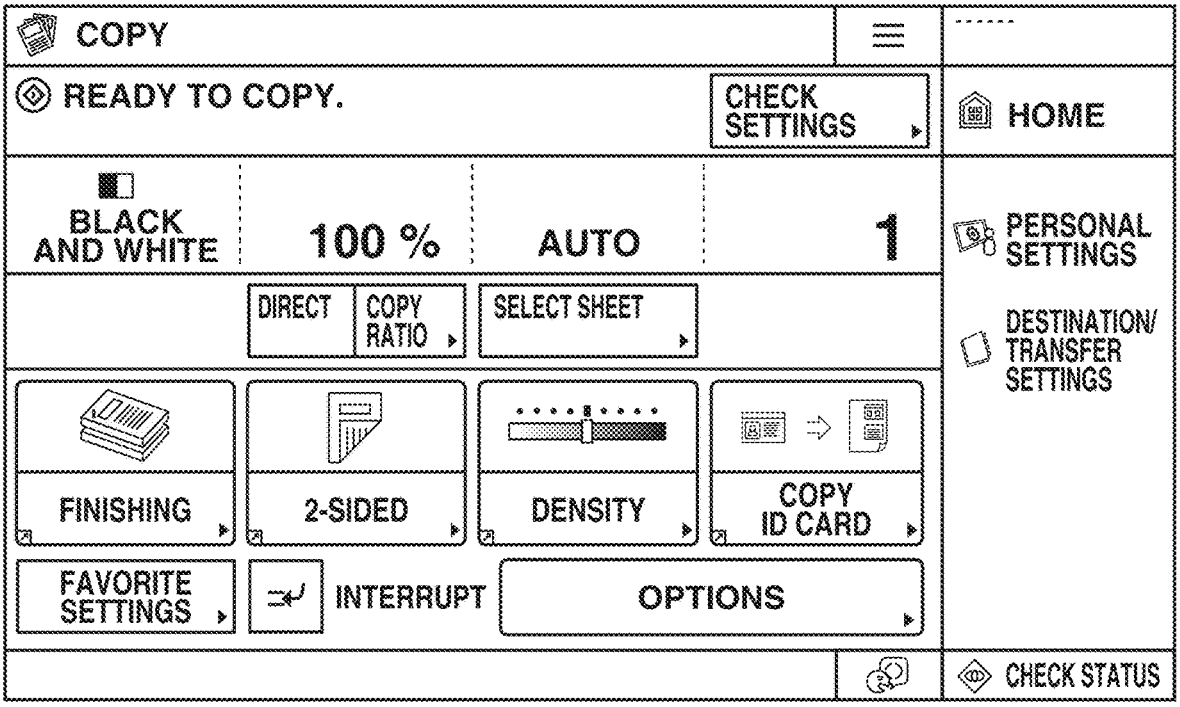

FIG. 11A is a diagram illustrating an example of a home screen that is displayed on a display unit of the image forming apparatus 100 according to the present exemplary embodiment. The home screen is a screen for receiving an instruction to display a screen that prompts a user to make a setting of a function provided by the image forming apparatus 100. For example, if the user taps a "copy" button 701, the display unit displays a copy screen that prompts the user to make copy settings as illustrated in FIG. 11B. FIG. 11B is a diagram illustrating an example of the copy screen. On the copy screen, the user can make copy-related settings of the number of copies to be printed, the copy ratio for enlargement and reduction in printing, the type of sheets for use in printing, and the like.

If the button 702 is selected on the home screen illustrated in FIG. 11A, a screen (not illustrated) for making apparatus settings of the image forming apparatus 100 is displayed. If a user selects a "sheet setting" button on the screen, the sheet information setting screen illustrated in FIG. 4A is displayed.

FIG. 4A is a sheet setting screen traceable from the home screen, and the sheet setting screen includes sheet feeding cassette buttons 401 and a "settings" button 402. The sheet feeding cassette buttons 401 are buttons for selecting a sheet feeding cassette that is a setting change target. The "settings" button 402 is a button for changing to a screen for changing the settings of the selected sheet feeding cassette. The sheet setting screen further includes a sheet information region 404 and an "OK" button 403. The sheet information region 404 displays current setting formation about the selected sheet feeding cassette. The "OK" button 403 is a button for exiting the initial sheet setting screen. In FIG. 4A, the sheet feeding cassette buttons 401 are not selected, so that the sheet information region 404 does not display sheet information, and the "settings" button 402 is grayed out and is not selectable.

A user selects a button that corresponds to the sheet feeding cassette 141 for which sheet information is to be set from the sheet feeding cassette buttons 401. If a sheet feeding cassette button 401 is selected, the color of the selected sheet feeding cassette button 401 is changed, and the sheet feeding cassette button 401 is changed to a selected state. At this time, the sheet information region 404 displays sheet information, such as a sheet size and a sheet type, set for the selected sheet feeding cassette 141. Further, the "settings" button 402 is no longer grayed out and becomes selectable.

Figure 5A:
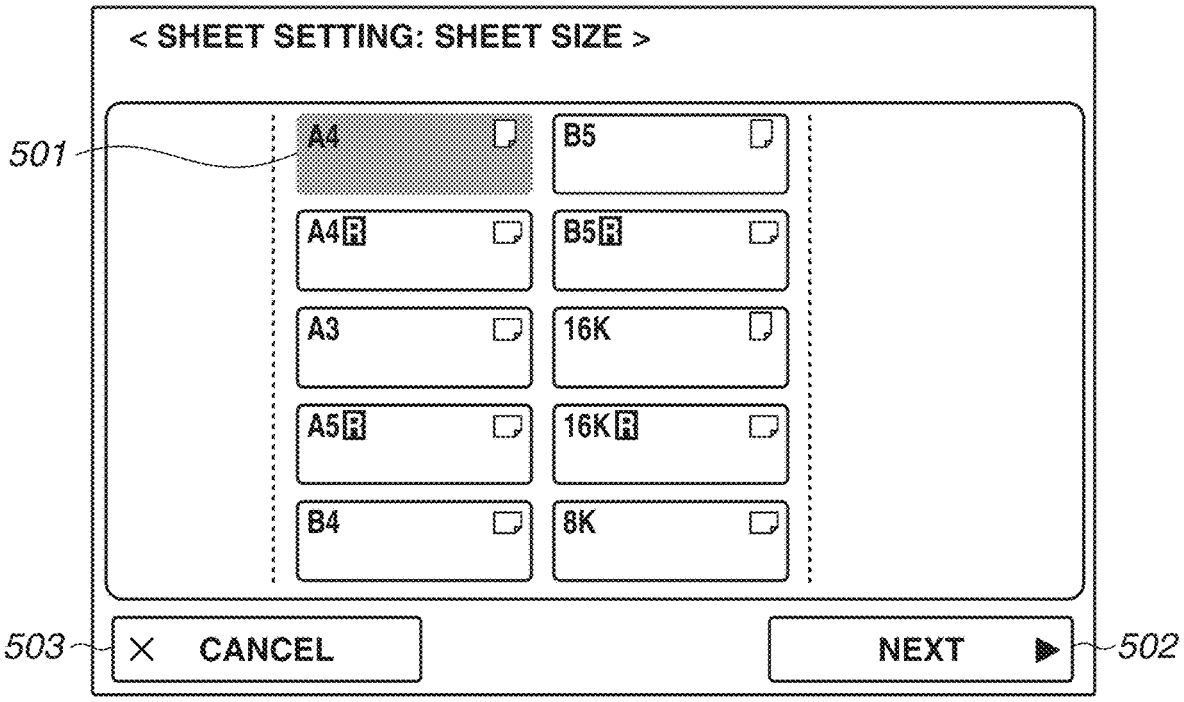
FIGS. 5A and 5B are respective diagrams illustrating examples of a sheet size setting screen and a sheet type setting screen of a sheet setting screen according to an exemplary embodiment.

At this time, if the user selects the "settings" button 402, a sheet size setting screen illustrated in FIG. 5A is displayed. The sheet size setting screen includes sheet size buttons 501, a "next" button 502, and a "cancel" button 503. The sheet size buttons 501 are buttons for selecting various standard sheet sizes. The "next" button 502 is a button for moving to a screen illustrated in FIG. 5B. The "cancel" button 503 is a button for clearing the previous settings and returning to the initial screen illustrated in FIG. 4A. A user selects the size of sheets stored in the sheet feeding cassette 141 that is selected in FIG. 4A from the sheet size buttons 501 and then selects the "next" button 502. Consequently, the screen illustrated in FIG. 5B is displayed on the operation unit 208.

Figure 5B:
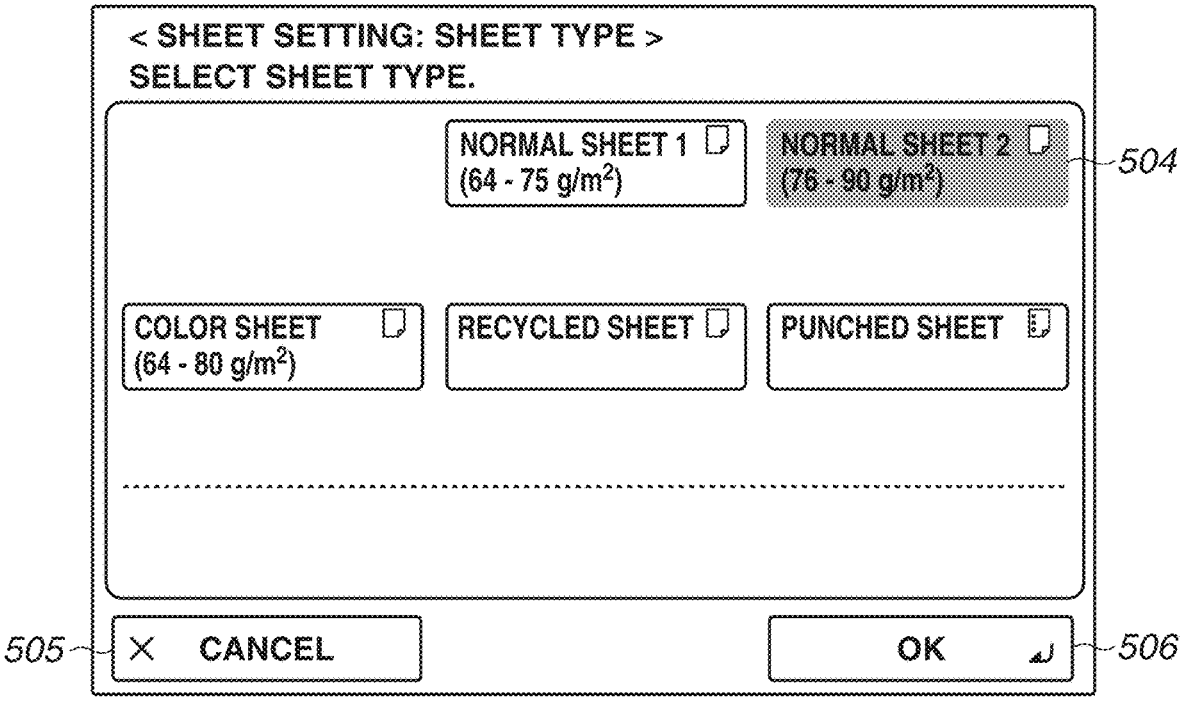

FIG. 5B illustrates a sheet type setting screen. The sheet type setting screen includes sheet type buttons 504, a "cancel" button 505, and an "OK" button 506. The sheet type buttons 504 are buttons for selecting various sheet types. The "cancel" button 505 is a button for clearing the previous settings and returning to the initial screen illustrated in FIG. 4A. The "OK" button 506 is a button for determining the settings for the sheet feeding cassette 141. If the "OK" button 506 is selected, the screen is returned to the initial screen illustrated in FIG. 4A while the sheet size/type settings are internally determined and are reflected to the target sheet feeding cassette 141. The sheet type refers to the type of a sheet set in the sheet feeding cassette 141, such as a normal sheet, a thick sheet, a thin sheet, or a punched sheet.

A case where a user selects a button 702 on the home screen to display the "sheet setting" screen is described above as an example. Alternatively, sheet information can be set by setting a sheet in the sheet feeding cassette 141. In a case where a user opens the sheet feeding cassette 141, sets a sheet in the sheet feeding cassette 141, and stores the sheet feeding cassette 141 in the cassette storage unit of the image forming apparatus 100, the screen illustrated in FIG. 4B is displayed as a pop-up screen. As in FIG. 4A, the screen illustrated in FIG. 4B includes sheet feeding cassette buttons 405 and a "settings" button 406. The sheet feeding cassette buttons 405 are buttons for selecting the sheet feeding cassette 141 that is a setting change target. The "settings" button 406 is a button for changing to a screen for changing the settings of the selected sheet feeding cassette 141. The sheet feeding cassette 141 from which a sheet feeding operation is detected is automatically set as the sheet feeding cassette 141 that is a setting change target, and the set sheet feeding cassette 141 is highlighted. The screen illustrated in FIG. 4B further includes a sheet information region 407 and an "OK" button 408. The sheet information region 407 is a button for displaying current setting information about the selected sheet feeding cassette 141. The "OK" button 408 is a button for exiting the initial sheet setting screen. Information about the sheet feeding cassette 141 that is opened and closed and stores a sheet is displayed as the current setting information about the sheet feeding cassette 141.

While a procedure for displaying the sheet setting screen illustrated in FIG. 4A is different from a procedure for displaying the sheet setting screen illustrated in FIG. 4B, the basic button layouts displayed on the respective screens are the same. In a case where the "settings" button 402 or 406 is selected, the screen is changed to the sheet size setting screen in FIG. 5A or the sheet type setting screen in FIG. 5B described below. In a case where the "OK" button 403 or 408 is selected, the initial sheet information setting screen is exited. In the first exemplary embodiment, while the screen illustrated in FIG. 4A is displayed, even if the opening and closing of the sheet feeding cassette 141 and the presence of a sheet in the sheet feeding cassette 141 are detected, the screen illustrated in FIG. 4B is not displayed. While the screen illustrated in FIG. 4B is displayed, the screen illustrated in FIG. 4A cannot be displayed unless the "OK" button 408 is pressed to exit the screen illustrated in FIG. 4B.

<UI Screen of Sheet Setting Screen for Manual Sheet Feeding Tray>

Next, operations in a case where a user sets a sheet on the manual sheet feeding tray 142 will schematically be described below.

Figure 6:
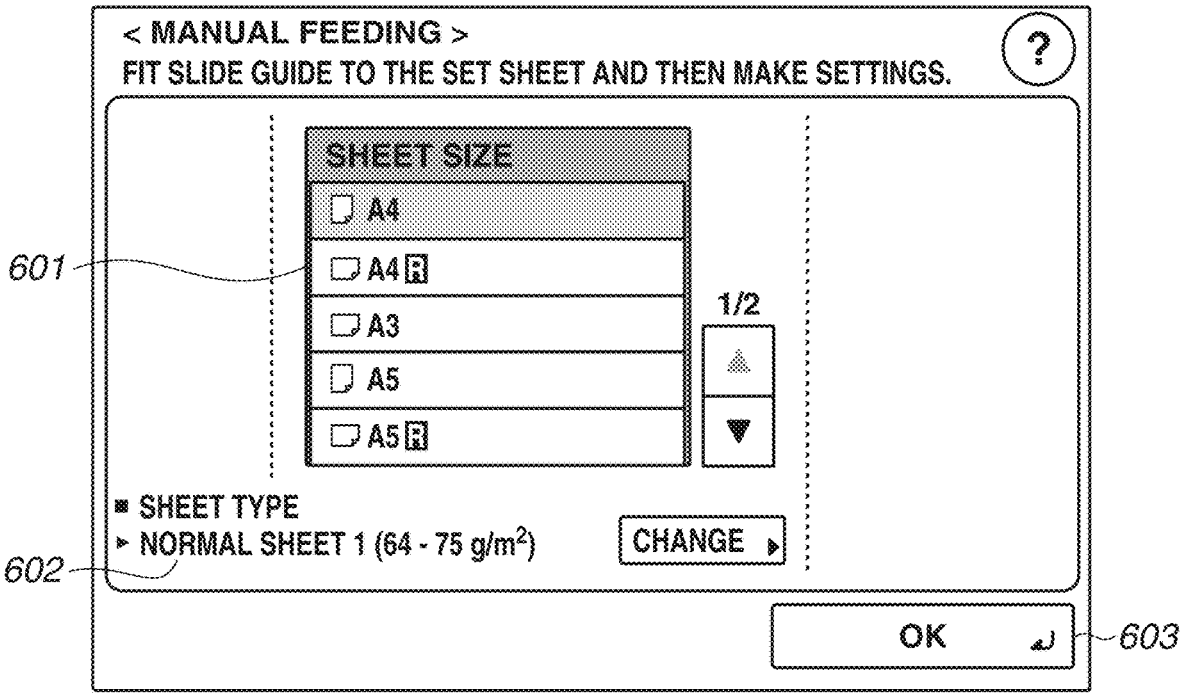
FIG. 6 is a diagram illustrating an example of a sheet setting screen for a manual sheet feeding tray according to an exemplary embodiment.

FIG. 6 illustrates an example of a sheet setting screen for the manual sheet feeding tray 142 of the image forming apparatus 100 that is displayed on the operation unit 208 of the image forming apparatus 100. The sheet setting screen for the manual sheet feeding tray 142 is displayed as a pop-up at a timing at which the placement of a sheet on the manual sheet feeding tray 142 is detected. In the first exemplary embodiment, while the pop-up screen illustrated in FIG. 4B is displayed, even if a sheet is set on the manual sheet feeding tray 142, the pop-up screen illustrated in FIG. 6 is not displayed. Thereafter, the pop-up sheet setting screen for the manual sheet feeding tray 142 is displayed at a timing at which the sheet setting for the sheet feeding cassette 141 is ended.

The sheet information setting screen for the manual sheet feeding tray 142 includes sheet size buttons 601, a sheet type change region 602, and an "OK" button 603. The sheet size buttons 601 are buttons for selecting a sheet size from the list. The sheet type change region 602 is a region for changing the sheet type. The "OK" button 603 is a button for determining the sheet size and sheet type settings. After setting the sheet size and the sheet type, the user selects the "OK" button 603 to end and reflect the sheet settings for the manual sheet feeding tray 142. After the "OK" button 603 is selected, the screen disappears, and the previous screen displayed before the display of the sheet information setting screen for the manual sheet feeding tray 142 is displayed.

<Flowchart of Process of Controlling Sheet Setting Screen for Sheet Feeding Cassette>

A process that is executed by the image forming apparatus 100 according to the first exemplary embodiment will be described below with reference to a flowchart.

Figure 7:
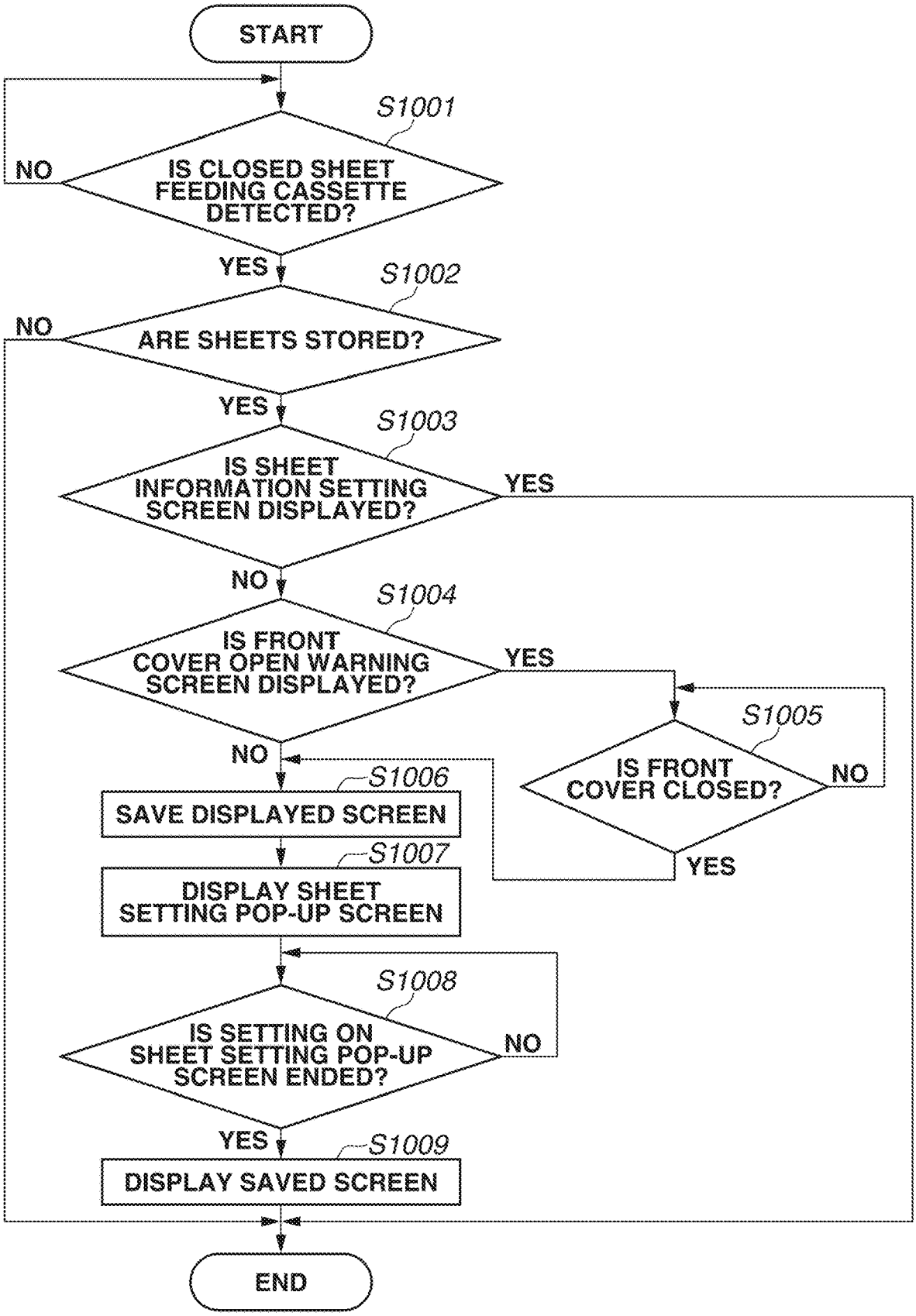
FIG. 7 is a flowchart illustrating a process of controlling a sheet setting screen for a sheet feeding cassette according to a first exemplary embodiment.

FIG. 7 is a flowchart illustrating a process of controlling the pop-up display of the sheet setting screen in a case where a sheet feeding operation on the sheet feeding cassette 141 is detected. A program for executing the flowchart illustrated in FIG. 7 is stored in the auxiliary storage apparatus 203, and the CPU 201 loads the program to the main storage apparatus 202 and executes the program to thereby realize the process.

In the detection of a sheet feeding operation, in a case where the sheet feeding cassette 141 is closed and a sheet is in the sheet feeding cassette 141, it is determined that a medium is fed by a user. If a sheet feeding operation is detected, whether a sheet setting screen traceable from the normal menu illustrated in FIG. 4A is displayed on the screen displayed on the operation unit 208 is determined, and in a case where the sheet setting screen is displayed, since it is unnecessary to re-display the pop-up sheet setting screen, the process ends without executing a process. On the other hand, in a case where the sheet setting screen is not displayed, the pop-up screen illustrated in FIG. 4B is displayed. Even in a case where the sheet setting screen for the manual sheet feeding tray 142 is displayed, the pop-up screen illustrated in FIG. 4B is displayed. If a user opens the sheet feeding cassette 141, the process starts.

First, in step S1001, the CPU 201 controls the device I/F control unit 302 and determines whether the closing of the sheet feeding cassette 141 of the image forming apparatus 100 is detected. In a case where the sheet feeding cassette 141 is not closed (NO in step S1001), the processing returns to the previous step, and the process is repeated. On the other hand, in a case where the closing of the sheet feeding cassette 141 is detected (YES in step S1001), the processing proceeds to step S1002.

In step S1002, the CPU 201 controls the device I/F control unit 302 and determines whether a sheet is stored in the sheet feeding cassette 141 detected as being closed in step S1001. The storage unit for storing the sheet feeding cassette 141 includes a sensor that determines whether a sheet is fed to the sheet feeding cassette 141. The CPU 201 determines whether a sheet is stored in the sheet feeding cassette 141 based on an output result of the sensor (not illustrated) of the storage unit. In a case where a sheet is not stored (NO in step S1002), the process ends. On the other hand, in a case where a sheet is stored in the sheet feeding cassette 141 (YES in step S1002), the processing proceeds to step S1003.

In step S1003, the CPU 201 controls the screen display control unit 301 and determines whether the sheet information setting screen is displayed on the screen displayed on the operation unit 208. The sheet information setting screen refers to the screen illustrated in FIG. 4A. The CPU 201 acquires identification information about the displayed screen and compares the acquired identification information about the screen with preset identification information about the screen that corresponds to FIG. 4A. In a case where the acquired identification information and the preset identification information match (YES in step S1003), the process illustrated in FIG. 7 ends. On the other hand, in a case where the acquired identification information and the preset identification information do not match (NO in step S1003), step S1004 is executed. The processing proceeds to step S1004 even in a case where the screen displayed on the operation unit 208 displays the sheet setting screen for the manual sheet feeding tray 142 illustrated in FIG. 6.

Figure 10:
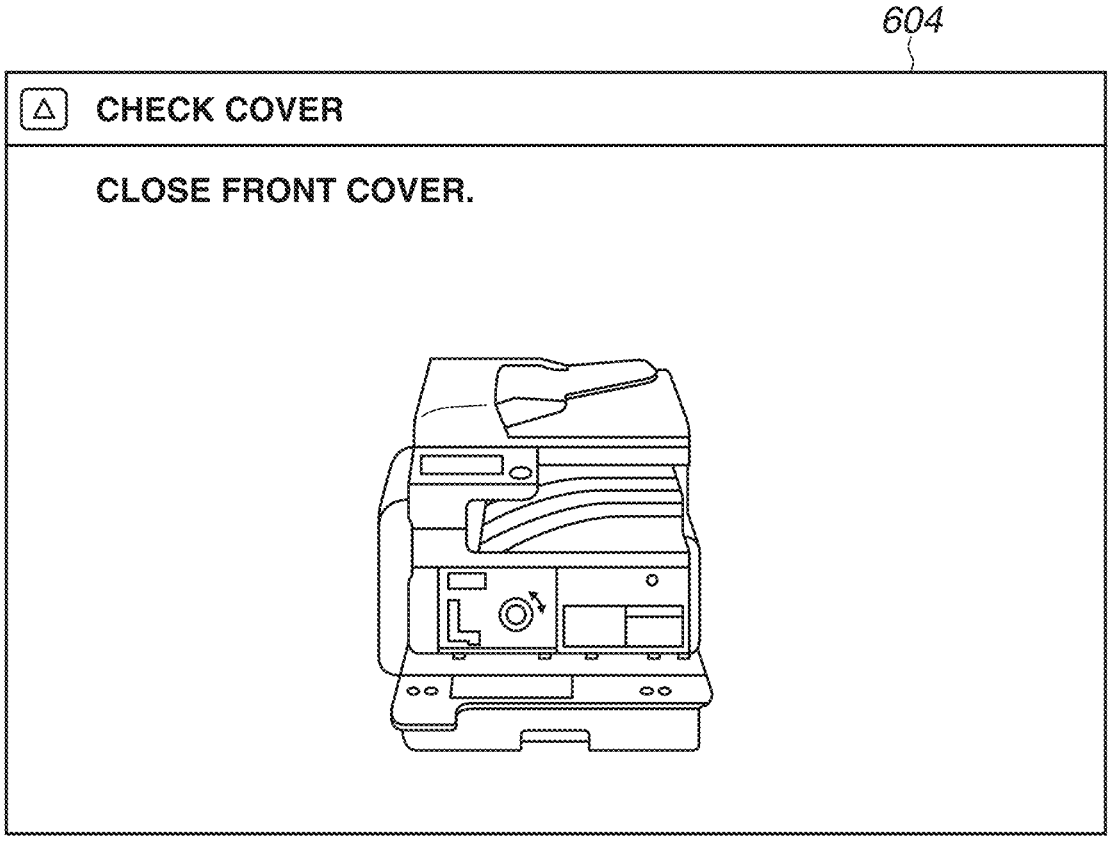
FIG. 10 is a diagram illustrating an example of a warning screen in a case where a front cover is opened according to an exemplary embodiment.

In step S1004, the CPU 201 controls the screen display control unit 301 and determines whether the operation unit 208 displays a front cover open warning screen. The front cover open warning screen refers to a screen illustrated in FIG. 10. The front cover open warning screen is a screen that prompts a user to close a front cover of the image forming apparatus 100 in a case where the front cover is opened. The CPU 201 compares identification information about the displayed screen with identification information about the front cover open warning screen and determines whether the front cover open warning screen is displayed. In a case where the front cover open warning screen is displayed (YES in step S1004), the processing proceeds to step S1005. On the other hand, in a case where the front cover open warning screen is not displayed (NO in step S1004), the processing proceeds to step S1006.

In step S1005, the CPU 201 controls the device I/F control unit 302 and determines whether the front cover is closed. The image forming apparatus 100 detects the opening and closing of the front cover using a sensor (not illustrated). In a case where the CPU 201 detects the closing of the front cover based on a detection result of the sensor that is acquired via the device I/F control unit 302 (YES in step S1005), the processing proceeds to step S1006. Step S1005 is executed until the front cover is closed. If the front cover is closed, the previous screen displayed before the display of the front cover open warning screen, where the front cover warning screen is hidden is displayed on the operation unit 208.

In step S1006, the CPU 201 controls the screen display control unit 301 and temporarily internally holds and saves the screen displayed on the operation unit 208 together with internal information. For example, in step S1006, the CPU 201 stores identification information about the displayed screen and information about parameters set on the screen in the main storage apparatus 202. For example, in a case where the copy screen illustrated in FIG. 11B is displayed on the operation unit 208, the CPU 201 stores identification information indicating the copy screen and information set on the copy screen, such as the number of copies to be printed, the copy ratio, and the sheet type to be used, in the main storage apparatus 202. In a case where the front cover is closed in step S1005, information about the screen can be saved in the memory without displaying the previous screen displayed before the display of the front cover open warning screen. While the copy screen is described as an example, a screen different from the sheet information setting screen, such as a scan setting screen, a setting screen that relates to transmission of image data stored in the image forming apparatus 100, or a home screen, can be employed.

In step S1007, the CPU 201 controls the screen display control unit 301 and displays the pop-up screen illustrated in FIG. 4B on the operation unit 208. The CPU 201 acquires information about the sheet feeding cassette 141 detected as being closed in step S1001. Then, the sheet setting screen (FIG. 4B) in a state where the sheet feeding cassette button 401 corresponding to the sheet feeding cassette 141 detected as being closed is selected is displayed on the operation unit 208 based on the acquired information.

In step S1008, the CPU 201 controls the screen display control unit 301 and determines whether the setting on the sheet setting screen for the sheet feeding cassette 141 in FIG. 4B is ended. In a case where the setting is not ended (NO in step S1008), the processing returns to step S1008, and the process is repeated. On the other hand, in a case where the setting is ended (YES in step S1008), the processing proceeds to step S1009. In a case where the "OK" button 408 in FIG. 4B or the "OK" button 506 in FIG. 5B is selected, the processing proceeds to step S1009.

In step S1009, the CPU 201 controls the screen display control unit 301 and restores the screen that is internally held and saved in step S1006. Consequently, the screen displayed before the display of the screen illustrated in FIG. 4B can be displayed on the operation unit 208. After the screen is restored, the process ends.

By the above-described process, the pop-up display of the sheet setting screen in a case where a predetermined operation is performed on the sheet feeding cassette 141 is controlled. As described above, in a case where the sheet information setting screen illustrated in FIG. 4A is displayed, even if the closing of the sheet feeding cassette 141 is detected, the pop-up sheet setting screen illustrated in FIG. 4B is not displayed. This prevents cancellation of an unfinished sheet information setting that a user is setting, and also prevents a user from being confused about which sheet feeding cassette 141 the user is making a setting for.

In the above-described process, the sheet information setting screen illustrated in FIG. 4B is displayed in a case where the sheet feeding cassette 141 is opened and closed and a sheet is stored in the sheet feeding cassette 141. Alternatively, step S1003 can be executed based on the opening of the sheet feeding cassette 141, or step S1003 can be executed without executing step S1002 based on the closing of the sheet feeding cassette 141.

<Flowchart of Process of Controlling Sheet Setting Screen for Manual Sheet Feeding Tray>

Figure 8:
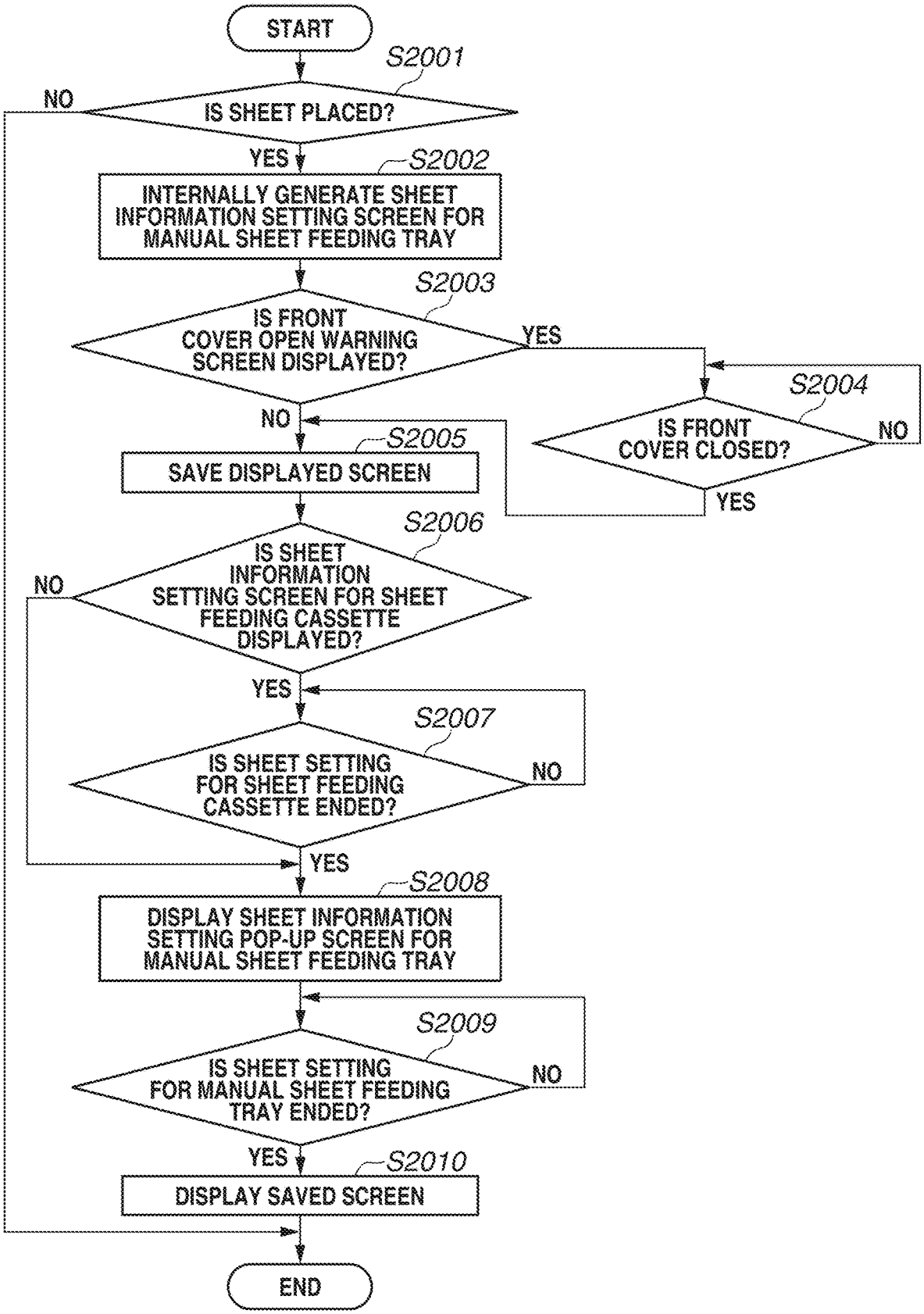
FIG. 8 is a flowchart illustrating a process of controlling a sheet setting screen for a manual sheet feeding tray according to the first exemplary embodiment.

Next, a process of controlling the pop-up display of the sheet setting screen in a case where a sheet feeding operation on the manual sheet feeding tray 142 is detected will be described below with reference to a flowchart in FIG. 8. A program for executing the process illustrated in FIG. 8 is stored in the auxiliary storage apparatus 203, and the CPU 201 reads the program, loads the program to the main storage apparatus 202, and executes the program to thereby realize the process. Steps S2001 and S2004 are realized by the CPU 201 by controlling the device I/F control unit 302. Steps S2002, S2003, S2005 and the subsequent steps are realized by the CPU 201 by controlling the screen display control unit 301.

In the detection of a sheet feeding operation, in a case where the placement of a sheet on the manual sheet feeding tray 142 is detected, it is determined that a medium is fed by a user. In a case where a sheet feeding operation is detected, whether the pop-up screen illustrated in FIG. 4B is displayed on the operation unit 208 is determined. In a case where the pop-up screen illustrated in FIG. 4B is not displayed, the pop-up screen illustrated in FIG. 6 is displayed. On the other hand, in a case where the pop-up screen illustrated in FIG. 4B is displayed, a sheet setting screen for the manual sheet feeding tray 142 is internally generated, and the CPU 201 waits. Thereafter, at a timing at which the ending of the sheet setting for the sheet feeding cassette 141 is detected, the generated sheet setting screen for the manual sheet feeding tray 142 is displayed as a pop-up. In a case where the sheet setting for the manual sheet feeding tray 142 is ended, the process ends.

First, in step S2001, the CPU 201 controls the device I/F control unit 302 and determines whether a sheet is placed and present on the manual sheet feeding tray 142. The manual sheet feeding tray 142 includes a sensor (not illustrated) for detecting the placement of a sheet. In step S2001, the CPU 201 determines whether a sheet is set on the manual sheet feeding tray 142 based on a detection result of the sensor.

In a case where a sheet is not placed on the manual sheet feeding tray 142 (NO in step S2001), the process illustrated in FIG. 8 ends. On the other hand, in a case where a sheet is on the manual sheet feeding tray 142 (YES in step S2001), the processing proceeds to step S2002.

In step S2002, the CPU 201 controls the screen display control unit 301, internally generates a sheet setting screen for the manual sheet feeding tray 142, and stores the generated sheet setting screen in the main storage apparatus 202. The sheet setting screen for the manual sheet feeding tray 142 is, for example, the screen illustrated in FIG. 6. The sheet information setting screen for the manual sheet feeding tray 142 can be stored in not the main storage apparatus 202 but another memory.

In step S2003, the CPU 201 controls the screen display control unit 301 and determines whether the front cover open warning screen is displayed. Whether the front cover open warning screen is displayed may be determined by a method similar to that in step S1004 in FIG. 7 or by a different method. In a case where the front cover open warning screen is displayed (YES in step S2003), the processing proceeds to step S2004. On the other hand, in a case where the front cover open warning screen is not displayed (NO in step S2003), the processing proceeds to step S2005.

In step S2004, the CPU 201 controls the device I/F control unit 302 and determines whether the front cover is closed. The process in step S2004 may be a process similar to the process in step S1005 in FIG. 7 or may be a different process. In step S2004, in a case where the front cover is closed (YES in step S2004), the front cover open warning screen is hidden, and the previous screen displayed before the display of the front cover open warning screen is displayed on the operation unit 208.

In step S2005, the CPU 201 controls the screen display control unit 301 and stores information about the displayed screen in the main storage apparatus 202. The CPU 201 stores identification information about the displayed screen and the setting values set on the screen in the main storage apparatus 202. The sheet information setting screen for the manual sheet feeding tray 142 can be stored in not the main storage apparatus 202 but another memory.

In step S2006, the CPU 201 controls the screen display control unit 301 and determines whether the screen displayed on the operation unit 208 is the sheet information setting screen for the sheet feeding cassette 141 in FIG. 4A. In step S2006, as in step S1003, the CPU 201 compares identification information about the displayed screen with identification information about the screen stored in advance and determines whether the screen illustrated in FIG. 4A is displayed. In a case where the displayed screen is not the sheet setting screen for the sheet feeding cassette 141 (NO in step S2006), the processing proceeds to step S2008. On the other hand, in a case where the sheet setting screen for the sheet feeding cassette 141 is displayed (YES in step S2006), the processing proceeds to step S2007 without changing the display to the sheet information setting screen for the manual sheet feeding tray 142.

In step S2007, the CPU 201 controls the screen display control unit 301 and determines whether the sheet setting for the sheet feeding cassette 141 is ended. In a case where the sheet setting is not ended (NO in step S2007), the processing returns to the previous step, and the process is repeated. On the other hand, in a case where the sheet setting is ended (YES in step S2007), the processing proceeds to step S2008. A case where the sheet setting for the sheet feeding cassette 141 is ended is, for example, a case where the "OK" button 403 is selected in FIG. 4A.

In step S2008, the CPU 201 controls the screen display control unit 301 and displays the sheet information setting screen for the manual sheet feeding tray 142 that is internally generated and stored in the step S2002. As a result, the sheet information setting screen illustrated in FIG. 6 is displayed on the operation unit 208. In the first exemplary embodiment, the screen for setting information about a sheet set on the manual sheet feeding tray 142 is displayed after the sheet information setting for the sheet feeding cassette 141 is ended. Thus, in a case where a sheet is set on the manual sheet feeding tray 142 while sheet information is being set for the sheet feeding cassette 141, the screen illustrated in FIG. 6 is not immediately displayed, so that the user can continue to set the sheet information for the sheet feeding cassette 141. After the setting of sheet information for the sheet feeding cassette 141 is ended, the setting of sheet information about the sheet set on the manual sheet feeding tray 142 can be made.

In step S2009, the CPU 201 controls the screen display control unit 301 and determines whether the sheet setting for the manual sheet feeding tray 142 is ended. In a case where the sheet setting is not ended (NO in step S2009), step S2009 is repeated. On the other hand, in a case where the sheet setting is ended (YES in step S2009), the CPU 201 executes step S2010.

In step S2010, the CPU 201 controls the screen display control unit 301 and displays the screen saved in step S2005 on the operation unit 208.

By the above-described process, in a case where a sheet is set on the manual sheet feeding tray 142, the unfinished setting of sheet information for the sheet feeding cassette 141 is continued, and after the setting of sheet information is ended, the setting of information about the sheet set on the manual sheet feeding tray 142 can be made.

The display of the operation screen in a case where a sheet is set on the manual sheet feeding tray 142 is controlled by the above-described process.

According to the above-described exemplary embodiment of the present disclosure, the pop-up display of the sheet information setting screen for the sheet feeding cassette 141 on which a predetermined operation is performed is prevented while a setting is being changed using the sheet information setting screen. Thus, even in a case where a predetermined operation is performed, a user can continue the unfinished setting of sheet information.

In the above-described exemplary embodiment, in step S1003 in FIG. 7, whether to display the sheet information setting screen illustrated in FIG. 4B is changed based on whether the displayed screen is the sheet information setting screen illustrated in FIG. 4A. In step S1003, in a case where any one of the screens illustrated in FIGS. 4A, 5A, and 5B is displayed, the processing may proceed to step S1004.

In the first exemplary embodiment, the pop-up display of the sheet setting screen for the sheet feeding cassette 141 in FIG. 4B is performed preferentially over the sheet setting screen for the manual sheet feeding tray 142 in FIG. 6.

However, there are cases where it is desirable to control the display so as to make and determine the setting for the manual sheet feeding tray 142 preferentially over the sheet setting for the sheet feeding cassette 141, depending on device configurations and use cases. Thus, in a second exemplary embodiment, in a case where the sheet feeding cassette 141 is opened and closed and a sheet is stored in the sheet feeding cassette 141, the pop-up of the sheet information setting screen for the sheet feeding cassette 141 is not displayed until the setting of sheet information for the manual sheet feeding tray 142 is ended. Then, after the setting of sheet information for the manual sheet feeding tray 142 is ended, the pop-up of the sheet setting screen for the sheet feeding cassette 141 in FIG. 4B is displayed. Thus, even in a case where the sheet feeding cassette 141 is opened and closed while sheet information about the sheet set on the manual sheet feeding tray 142 is being set, the setting of sheet information for the manual sheet feeding tray 142 can be continued.

The configurations illustrated in FIGS. 1 to 6, 11A, and 11B are similar to those in the first exemplary embodiment, so that redundant descriptions thereof are omitted.

<Flowchart of Process of Controlling Sheet Setting Screen for Sheet Feeding Cassette>

A process of controlling the display of the pop-up of the sheet information setting screen in a case where the sheet feeding cassette 141 is opened and closed and a sheet is stored in the sheet feeding cassette 141 will be described below with reference to FIG. 9. The process illustrated in the flowchart is realized by the CPU 201 executing a program stored in the auxiliary storage apparatus 203. In the process illustrated in FIG. 9, a process similar to that in FIG. 7 is given the same reference numeral, and redundant descriptions thereof are omitted.

In step S1101, the CPU 201 controls the screen display control unit 301 and determines whether the sheet setting screen for the manual sheet feeding tray 142 is displayed. The CPU 201 determines whether the sheet setting screen for the manual sheet feeding tray 142 is displayed by comparing identification information about the sheet setting screen for the manual sheet feeding tray 142 in FIG. 6 with identification information about the displayed screen. In a case where the sheet setting screen for the manual sheet feeding tray 142 is not displayed (NO in step S1101), the processing proceeds to step S1006. On the other hand, in a case where the sheet setting screen for the manual sheet feeding tray 142 is displayed (YES in step S1101), the CPU 201 executes step S1102.

In step S1102, the CPU 201 controls the screen display control unit 301 and determines whether the setting of sheet information on the sheet setting screen for the manual sheet feeding tray 142 is ended. In a case where the "OK" button 603 is selected on the sheet setting screen for the manual sheet feeding tray 142 in FIG. 6, the sheet information setting screen for the manual sheet feeding tray 142 is hidden, and it is determined that the setting of sheet information is ended (YES in step S1102). On the other hand, the CPU 201 executes step S1102 (NO in step S1102) until the setting of sheet information on the sheet setting screen for the manual sheet feeding tray 142 is ended.

Step S1005 and the subsequent steps are similar to those in the first exemplary embodiment, so that redundant descriptions thereof are omitted.

Figure 9:
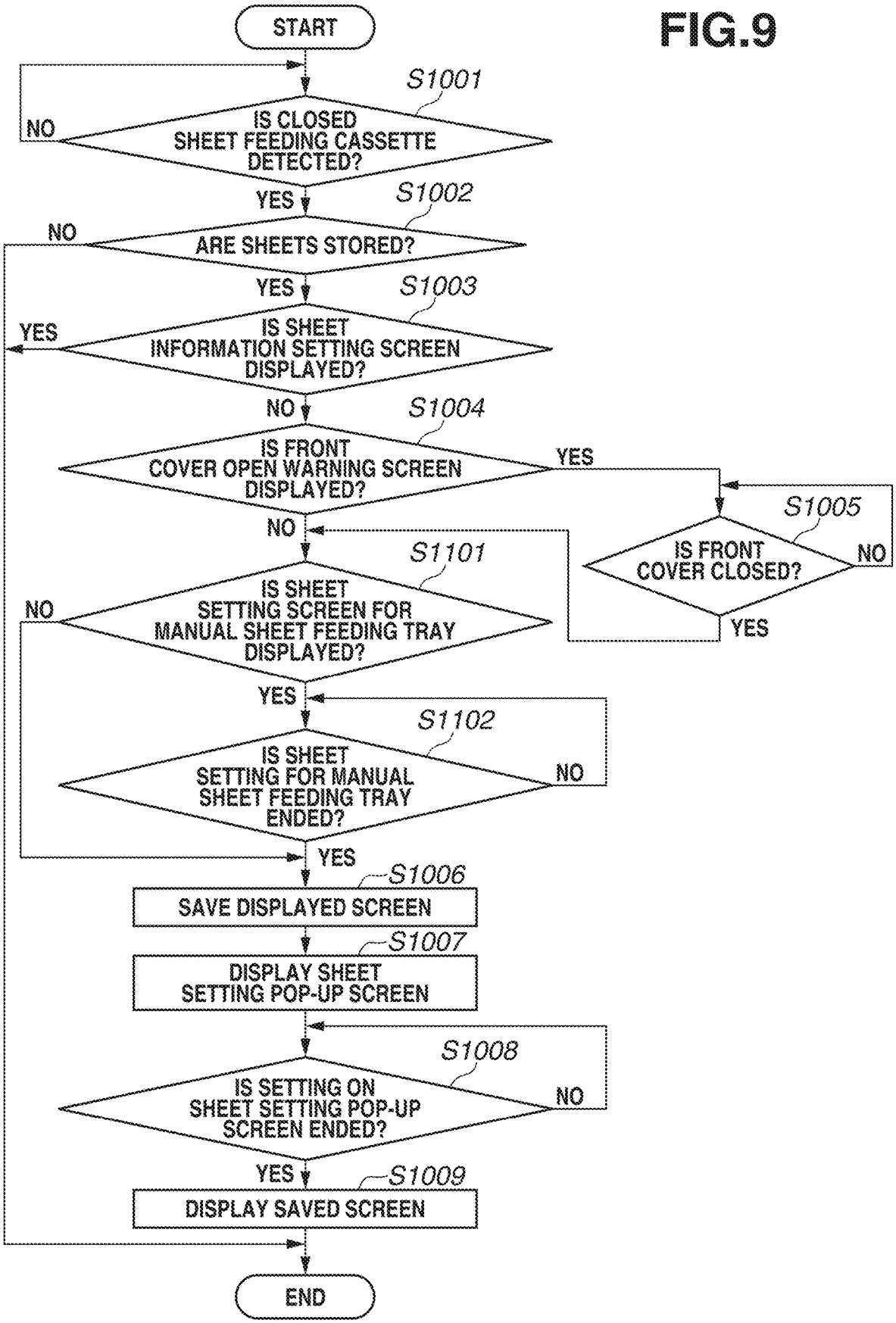
FIG. 9 is a flowchart illustrating a process of controlling a sheet setting screen for a sheet feeding cassette according to a second exemplary embodiment.

In FIG. 9, whether the sheet information setting screen is displayed is determined in a case where the sheet feeding cassette 141 is opened and closed and a sheet is stored in the sheet feeding cassette 141. Alternatively, step S1003 and the subsequent steps may be executed based on the opening of the sheet feeding cassette 141, or step S1002 may be skipped and step S1003 may be executed based on the closing of the sheet feeding cassette 141.

Next, a process in a case where a user sets a sheet on the manual sheet feeding tray 142 will be described below with reference to FIG. 8 described in the first exemplary embodiment. The image forming apparatus 100 according to the second exemplary embodiment executes a process excluding steps S2006 and S2007 in FIG. 8 in a case where a sheet is set on the manual sheet feeding tray 142.

Thus, in a case where a sheet is set on the manual sheet feeding tray 142 while the sheet setting screen for the sheet feeding cassette 141 is displayed, the setting of information about the sheet set on the manual sheet feeding tray 142 can be preferentially made.

By the above-described process, the screen illustrated in FIG. 4B is not displayed in a case where the sheet feeding cassette 141 is closed and a sheet is stored while the setting of sheet information about the sheet stored in the sheet feeding cassette 141 is being made. Further, in a case where the screen for setting sheet information about the sheet set on the manual sheet feeding tray 142 is displayed, the setting of sheet information for the sheet feeding cassette 141 that is closed after a sheet is stored can be made after the setting of sheet information about the sheet set on the manual sheet feeding tray 142 is ended.

Other Exemplary Embodiments

The present disclosure is also realized by executing the following process. Specifically, software (program) for realizing the functions of the above-described exemplary embodiments is supplied to a system or an apparatus via a network or various storage mediums, and a computer (or a CPU or a micro-processing unit (MPU)) of the system or the apparatus reads program codes and executes the program codes. In this case, the computer program and a storage medium that stores the computer program constitute the present disclosure.

With an image forming apparatus having the above-described configuration, a user can continue to make unfinished sheet information settings even if a predetermined operation is performed on a sheet feeding cassette while the setting of sheet information is ongoing.

OTHER EMBODIMENTS

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2020-071152, filed Apr. 10, 2020, which is hereby incorporated by reference herein in its entirety.

What is claimed is:

1. An image forming apparatus comprising:

one or more sheet storing units each configured to store a sheet;

an image forming unit configured to form an image on the sheet conveyed from a sheet storing unit that is one of the one or more sheet storing units;

a display unit configured to display a screen; and one or more processors configured to perform operations including:

causing the display unit to display, without operating any of the one or more sheet storing units, a setting screen for selecting the sheet storing unit from among the one or more sheet storing units in accordance with a user instruction, wherein a sheet size corresponding to the sheet storing unit selected by a user via the displayed setting screen is to be set, causing, based on a predetermined operation to move the sheet storing unit to store a sheet in the sheet storing unit in the image forming apparatus, the image forming apparatus to select the sheet storing unit in which the sheet is stored based on the predetermined operation, and causing the display unit to display the setting screen on which the sheet storing unit was selected by the image forming apparatus based on the predetermined operation, wherein the sheet storing unit is not selected on the setting screen by the image forming apparatus based on the predetermined operation in a situation where the setting screen was displayed without operating any of the one or more sheet storing units.

2. The image forming apparatus according to claim 1, wherein the predetermined operation is an operation of closing the sheet storing unit that stores at least one sheet.

3. The image forming apparatus according to claim 2, wherein the operations further include receiving an instruction to open the sheet storing unit, and wherein, based on the predetermined operation executed in a situation where a copy-related setting screen is displayed, the operations further include causing the display unit to display the setting screen on which the sheet storing unit was selected by the image forming apparatus.

4. The image forming apparatus according to claim 3, further comprising a detection unit configured to detect the operation of closing the sheet storing unit that stores the at least one sheet, wherein the operations further include causing the display unit to display the setting screen based on the detection of the operation by the detection unit of closing the sheet storing unit in a situation where the copy-related setting screen is displayed.

5. The image forming apparatus according to claim 1, wherein the setting screen is a first setting screen, wherein the operations further include causing the display unit to display, based on a user placing a sheet on a manual sheet feeding tray, a second setting screen for setting a sheet size of the sheet placed on the manual sheet feeding tray by the user, and wherein the operations further include causing the display unit to display, based on completion of setting via the second setting screen, the first setting screen in a case where the predetermined operation is executed in a situation where the second setting screen is displayed on the display unit.

6. The image forming apparatus according to claim 1, wherein the setting screen is a screen configured to display a size of a sheet that is fed by any of the one or more sheet storing units.

7. The image forming apparatus according to claim 1, further comprising a memory configured to store the sheet size set via the setting screen in association with an identifier of any of the one or more sheet storing units.

8. A method for an image forming apparatus having one or more sheet storing units each configured to store a sheet, an image forming unit configured to form an image on the sheet conveyed from a sheet storing unit that is one of the one or more sheet storing units, and a display unit configured to display a screen, the method comprising:

causing the display unit to display, without operating any of the one or more sheet storing units, a setting screen for selecting the sheet storing unit from among the one or more sheet storing units in accordance with a user instruction, wherein a sheet size corresponding to the sheet storing unit selected by a user via the displayed setting screen is to be set;

causing, based on a predetermined operation to move the sheet storing unit to store a sheet in the sheet storing unit in the image forming apparatus, the image forming apparatus to select the sheet storing unit in which the sheet is stored based on the predetermined operation; and causing the display unit to display the setting screen on which the sheet storing unit was selected by the image forming apparatus based on the predetermined operation, wherein the sheet storing unit is not selected on the setting screen by the image forming apparatus based on the predetermined operation in a situation where the setting screen was displayed without operating any of the one or more sheet storing units.

9. The image forming apparatus according to claim 1, wherein the setting screen is a second screen, and wherein the operations further include storing information of a first screen displayed before the second screen is displayed in a case where the predetermined operation is executed in a situation where the second screen has not been displayed.

10. The image forming apparatus according to claim 9, wherein the operations further include causing the display unit to display a third screen based on the stored information in accordance with completion of setting via the displayed first screen.

11. The image forming apparatus according to claim 1, wherein the operations further include, based on opening of a predetermined cover of the image forming apparatus, causing the display unit to display a screen related the predetermined cover and causing the display unit to display the setting screen in accordance with completion of displaying the screen related the predetermined cover in a case where the predetermined operation is executed in a situation where the predetermined cover is opened.

12. The image forming apparatus according to claim 1, wherein, initially, any one of the one or more storing units is not selected on the setting screen displayed in accordance with the user instruction.

* * * * *